US007234184B2

(12) United States Patent
Yang

(10) Patent No.: US 7,234,184 B2
(45) Date of Patent: Jun. 26, 2007

(54) INFLATABLE AIR CUSHION

(75) Inventor: Chou-Lian Yang, Taipei (TW)

(73) Assignee: Cheih Shang Co., Ltd., Taichung (TW)

( * ) Notice: Subject to any disclaimer, the term of this patent is extended or adjusted under 35 U.S.C. 154(b) by 36 days.

(21) Appl. No.: 11/208,599

(22) Filed: Aug. 23, 2005

(65) Prior Publication Data

US 2006/0288489 A1 Dec. 28, 2006

(30) Foreign Application Priority Data

Jun. 27, 2005 (TW) ..... 94121493 A

(51) Int. Cl.
*A47C 27/08* (2006.01)

(52) U.S. Cl. ..... 5/712; 5/655.3; 5/644

(58) Field of Classification Search ..... 5/706, 5/711, 712, 655.3, 644
See application file for complete search history.

(56) References Cited

U.S. PATENT DOCUMENTS 1,627,835 A * 5/1927 Combs ..... 5/712
4,675,930 A * 6/1987 Sargent ..... 5/655.4

* cited by examiner

*Primary Examiner*—Patricia Engle
*Assistant Examiner*—Fredrick Conley
(74) *Attorney, Agent, or Firm*—Bacon & Thomas, PLLC

(57) ABSTRACT

An inflatable air cushion has at least two sets of tension members therein. Each set of tension members includes multiple and parallel tension members. The tensile directions generated by the two sets of tension members are perpendicular. One of the tension members can be a strap member, and the other tension member can be a sheet member.

4 Claims, 10 Drawing Sheets

INFLATABLE AIR CUSHION

BACKGROUND OF THE INVENTION

1. Field of the Invention

The present invention relates to an inflatable air device, such as an inflatable mattress, inflatable sofa, inflatable bridge or an inflatable boat.

2. Description of the Related Art

When an inflatable mattress, cushion or other device is inflated, the surfaces on the device are usually arc-shaped; so, in order to provide a flat surface, many sheet members are typically mounted on the inflatable air cushion, as disclosed in U.S. Pat. No. 6,754,925, No. 6,618,884 and No. 5,598,593. Taking a rectangular air cushion as an example, for all six faces the prior art technologies only provide two "approximately flat" surfaces (the surfaces which a user can lie on), but no such "approximately flat" surfaces are provided for the other four surfaces. However, some applications for three-dimensional contours require a hexahedron with four or six approximately-flat surfaces, such as inflatable sofas.

Therefore, it is desirable to provide an inflatable air cushion with more than two flat surfaces to mitigate and/or obviate the aforementioned problems.

SUMMARY OF THE INVENTION

An objective of the present invention is to provide an inflatable air cushion in the shape of a hexahedron having four or six approximately-flat surfaces; taking a rectangular air cushion as an example, four or six surfaces are provided that are "approximately flat" when the cushion is inflated.

In order to achieve the above mentioned objective, the inflatable air cushion of the present invention has at least two sets of tension members therein. Each set of tension members includes multiple and parallel tension members. The directions of tensile force generated by the two sets of tension members are perpendicular. Both tension members can be strap members, or one of the tension members may be a strap member, and the other tension member may be a sheet member. When the tension member is a sheet member, it can have at least one aperture so that the strap member can pass through the aperture.

The inflatable air cushion of the present invention can also have three sets of tension members, wherein all can be strap members, or two strap members matching one sheet member. Taking a rectangular air cushion as an example, with three sets of tension members, all six faces of the rectangular air cushion are "approximately flat" when the rectangle air cushion is inflated.

Other objects, advantages, and novel features of the invention will become more apparent from the following detailed description when taken in conjunction with the accompanying drawings.

DETAILED DESCRIPTION OF THE PREFERRED EMBODIMENT

The following description provides nine embodiments.

Figure 1:
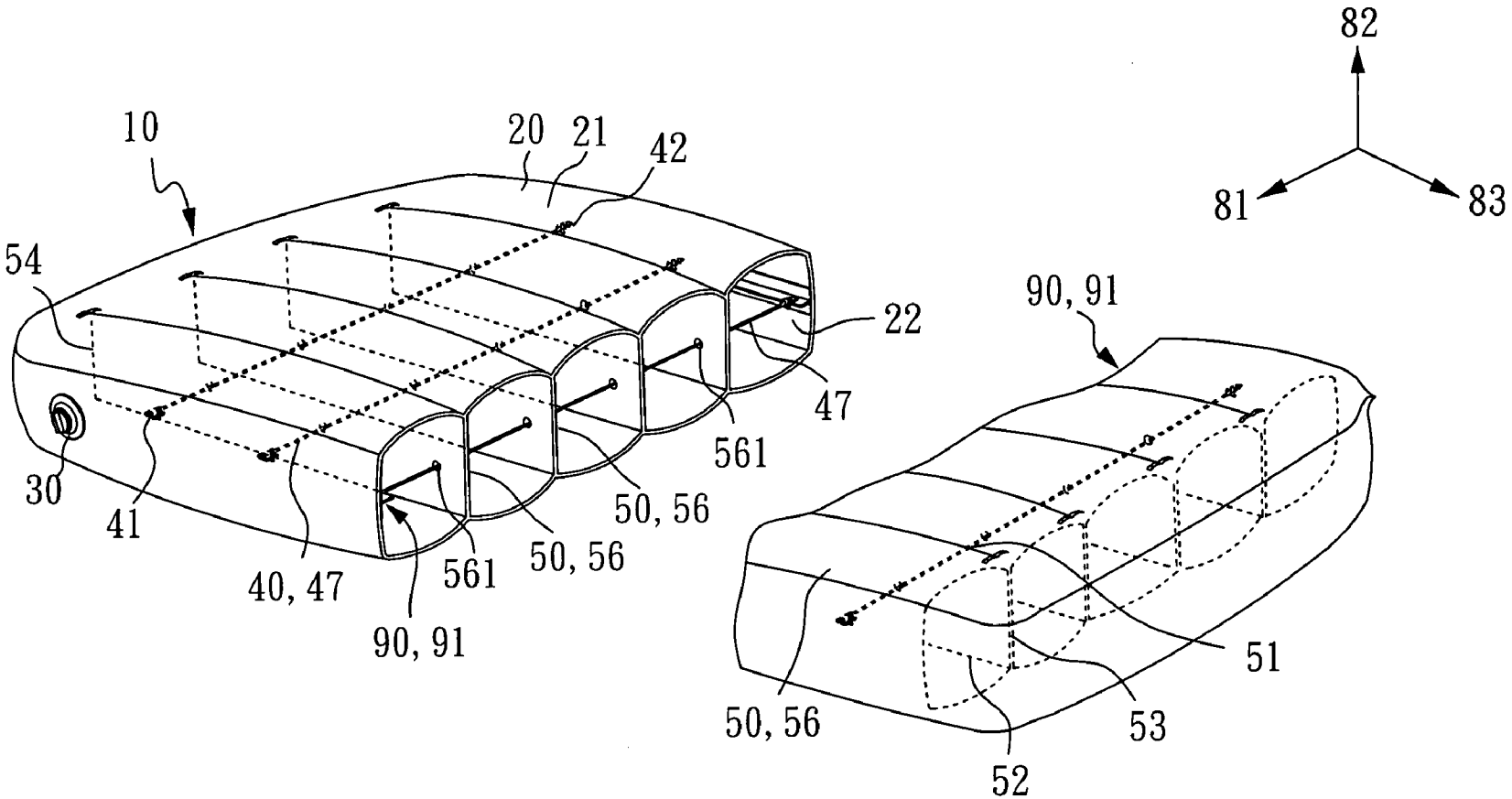
FIG. 1 is a perspective view of a first embodiment according to the present invention.
Figure 3:
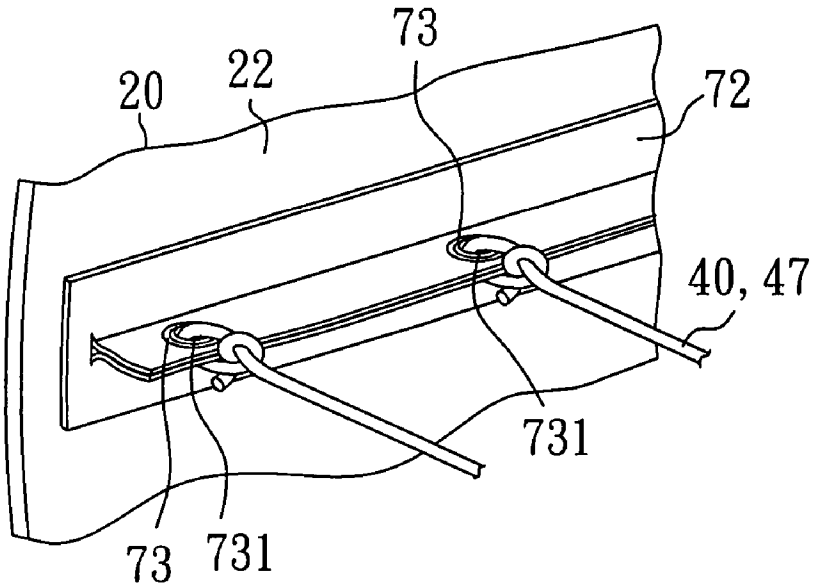
FIG. 3 is a perspective view showing connection between strap members and a cover in a second embodiment according to the present invention.

Please refer to FIG. 1 and FIG. 3. As shown in FIG. 1, an inflatable air cushion 10 comprises a cover 20 comprising an outer surface 21 and an inner surface 22, and a gas containment chamber 90 formed within the inner surface 22 of the cover 20. An inlet device 30 is installed on the cover 20 to insure the chamber 90 remains full after inflation of air cushion 10, and to provide storage convenience after deflating air cushion 10.

When the gas containment chamber 90 is inflated, a three-dimensional space 91 is formed, and a first direction axis 81, a second direction axis 82 and a third direction axis 83 define the three-dimensional space 91, wherein the axes are perpendicular to each other.

Figure 2:
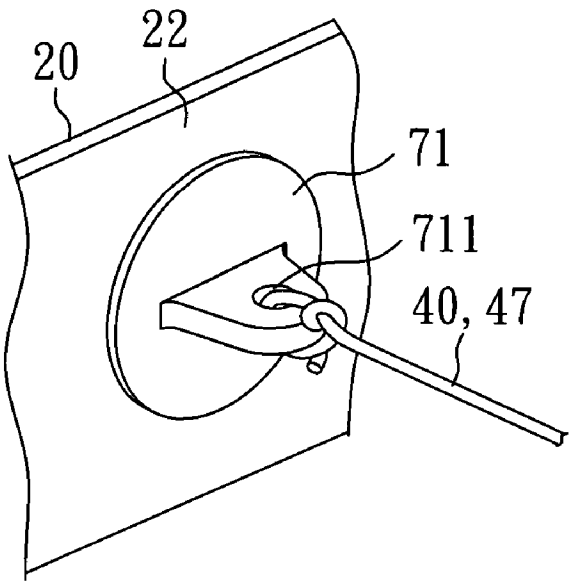
FIG. 2 is a perspective view showing a connection between strap members and a cover in a first embodiment according to the present invention.

The inflatable air cushion 10 further comprises a plurality of first tension members 40 and a plurality of second tension members 50. In the first embodiment, the second tension members 50 are sheet members 56; each sheet member 56 includes four ends 51, 52, 53, 54, wherein two ends 51, 52 are connected to the inner surface 22 of the cover 20 along the second direction axis 82. Therefore, when the inflatable air cushion 10 is fully inflated, it pulls along the second direction axis 82, but the other two ends are not connected to the inner surface 22 of the cover 20. The sheet member 56 is a well-known member, and so requires no further description. Every first tension member 40 is a strap member 47, and two ends 41, 42 of the strap member 47 are connected, along the first direction axis 81, to the inner surface 22 of the cover 20 so the strap member 47 along the first direction axis 81 comes under tension when the inflatable air cushion is inflated. Since strap members 47 are perpendicular to the sheet member 56, a plurality of apertures 561 on the sheet member 56 permit the strap members 47 to pass through. The strap members 47 can be connected to the cover 20 in various ways; for example, as shown in FIG. 2, a fixed base 71 with an aperture 711 is mounted on the inner surface 22 of the cover 20, and one end of the strap member 47 is connected to the fixed base 71 via the aperture 711. Another example, as shown in FIG. 3, has a long strip 72 mounted on the inner surface 22 of the cover 20, and a dish 73 with a plurality of apertures 731 is fixed on the long strip 72 so that one end of the plurality of strap members 47 can be connected to the dish 73 via the apertures 731.

Figure 4:
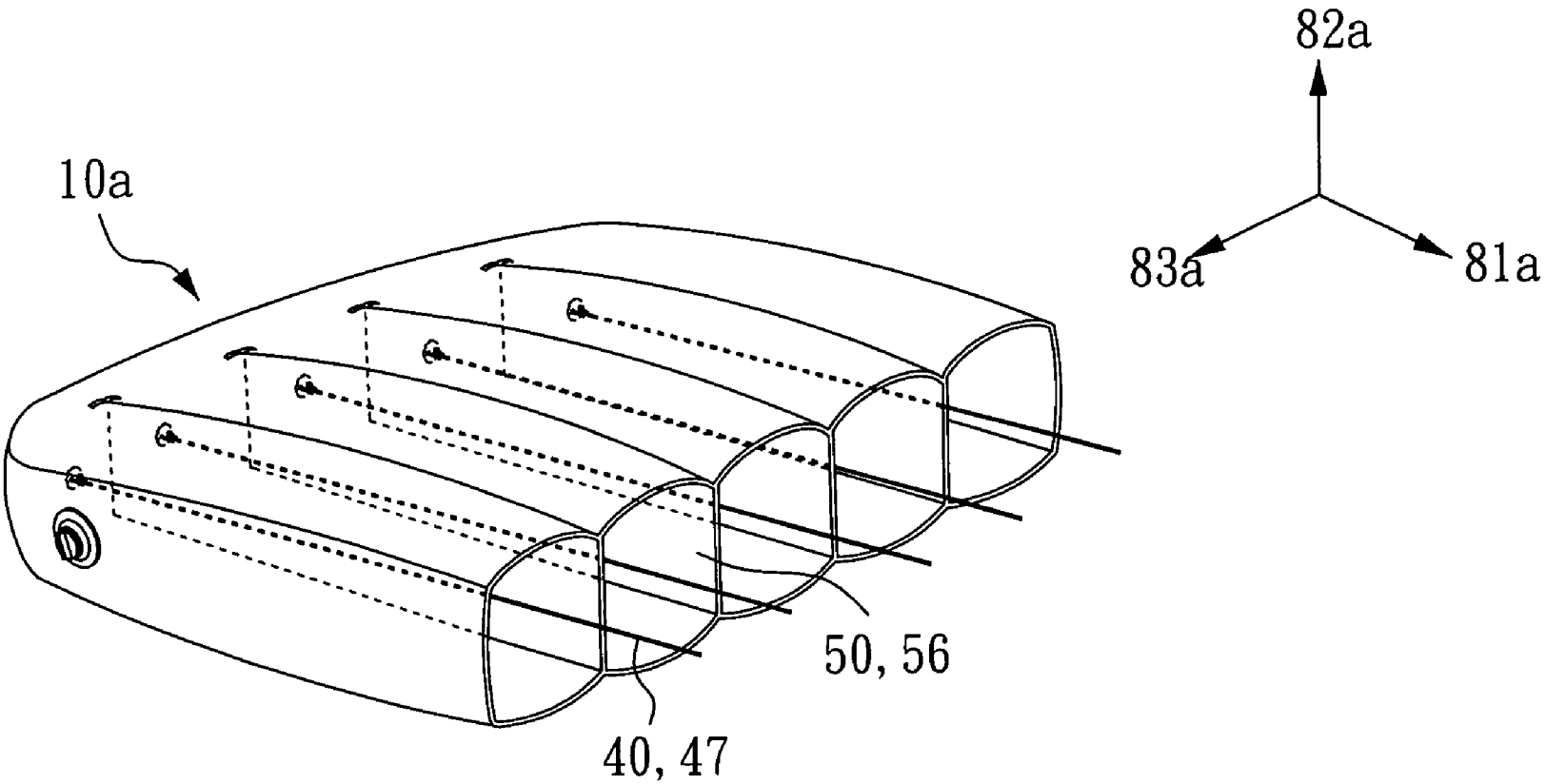
FIG. 4 is a perspective view of a second embodiment according to the present invention.

Please refer to FIG. 4 for a second embodiment. The major difference between the first and second embodiments is that the direction of extension of the strap member 47 of the inflatable air cushion 10*a* is identical to that of the sheet member 56, and so the sheet member 56 has no apertures 561. Both the strap member 47 along the first direction axis 81*a* and the sheet member 56 along the second direction axis 82*a* come under tension when the inflatable air cushion 10*a* is inflated.

Figure 5:
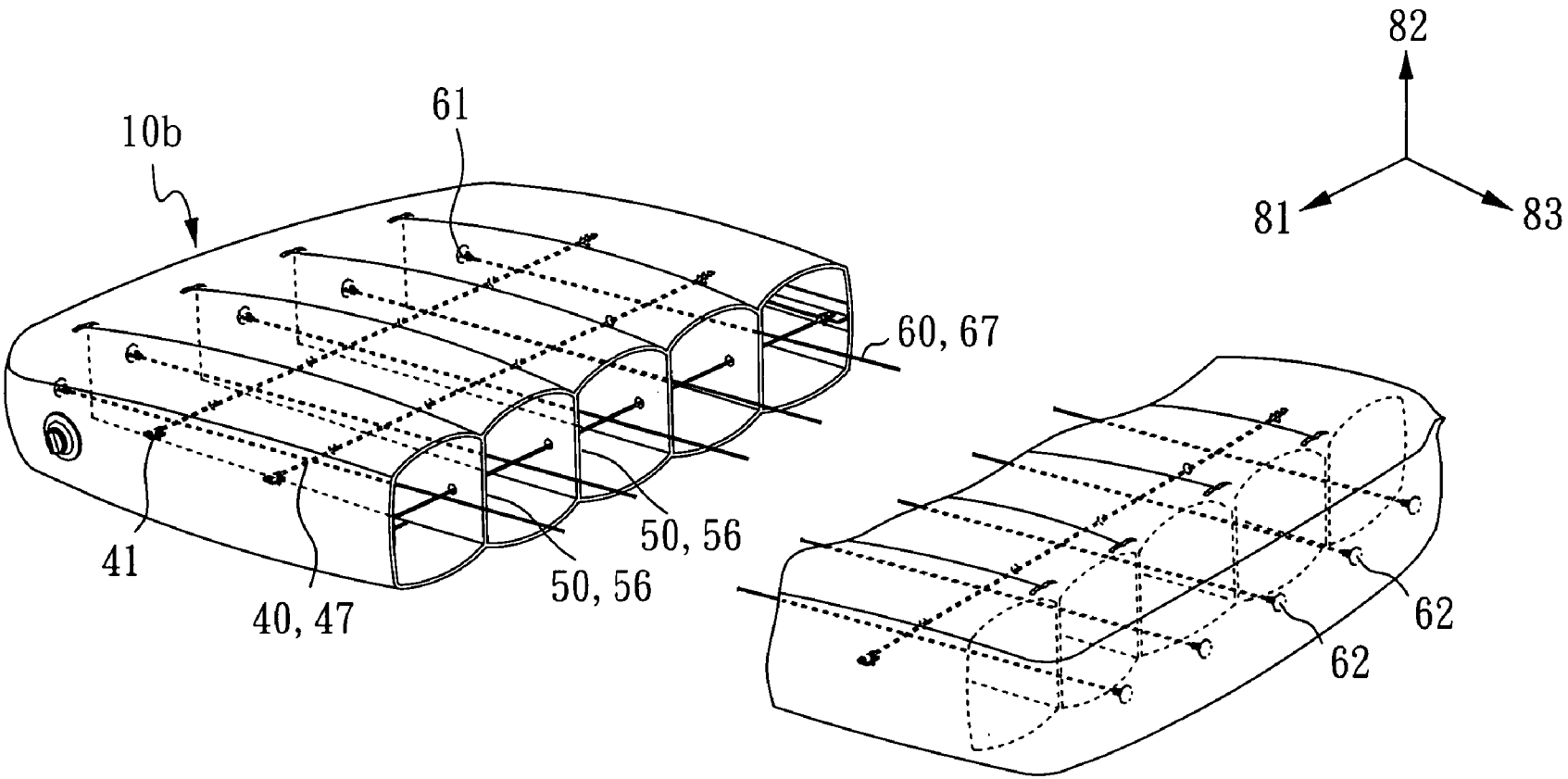
FIG. 5 is a perspective view of a third embodiment according to the present invention.

Please refer to FIG. 5 for a third embodiment. The major difference between the first and third embodiments is that the inflatable air cushion 10*b* further comprises a plurality of third tension members 60. Each third tension member 60 is a strap member 67, and has two ends 61, 62 connected to the inner surface 22 of the cover 20 so that the strap member 67 along the third direction axis 83 comes under tension when the inflatable air cushion 10*b* is inflated.

Figure 6:
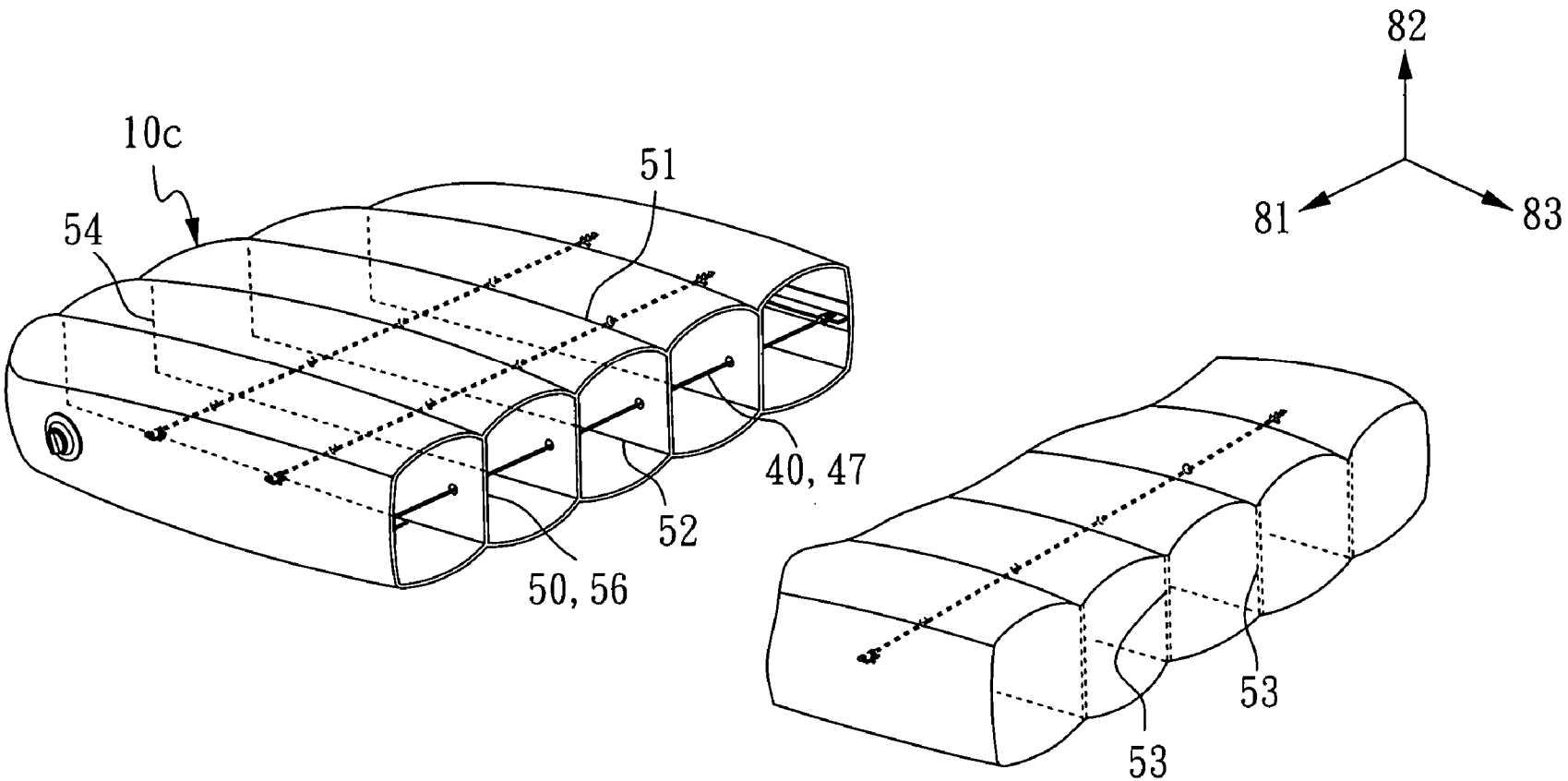
FIG. 6 is a perspective view of a fourth embodiment according to the present invention.

Please refer to FIG. 6 for a fourth embodiment. The major difference between the first and fourth embodiments is that two ends 53, 54 of the second tension members 50, 56 of the inflatable air cushion 10*c* are connected to the inner surface 22 so that the sheet member 56 along the third direction axis 83 comes under tension when the inflatable air cushion 10*c* is inflated.

Figure 7:
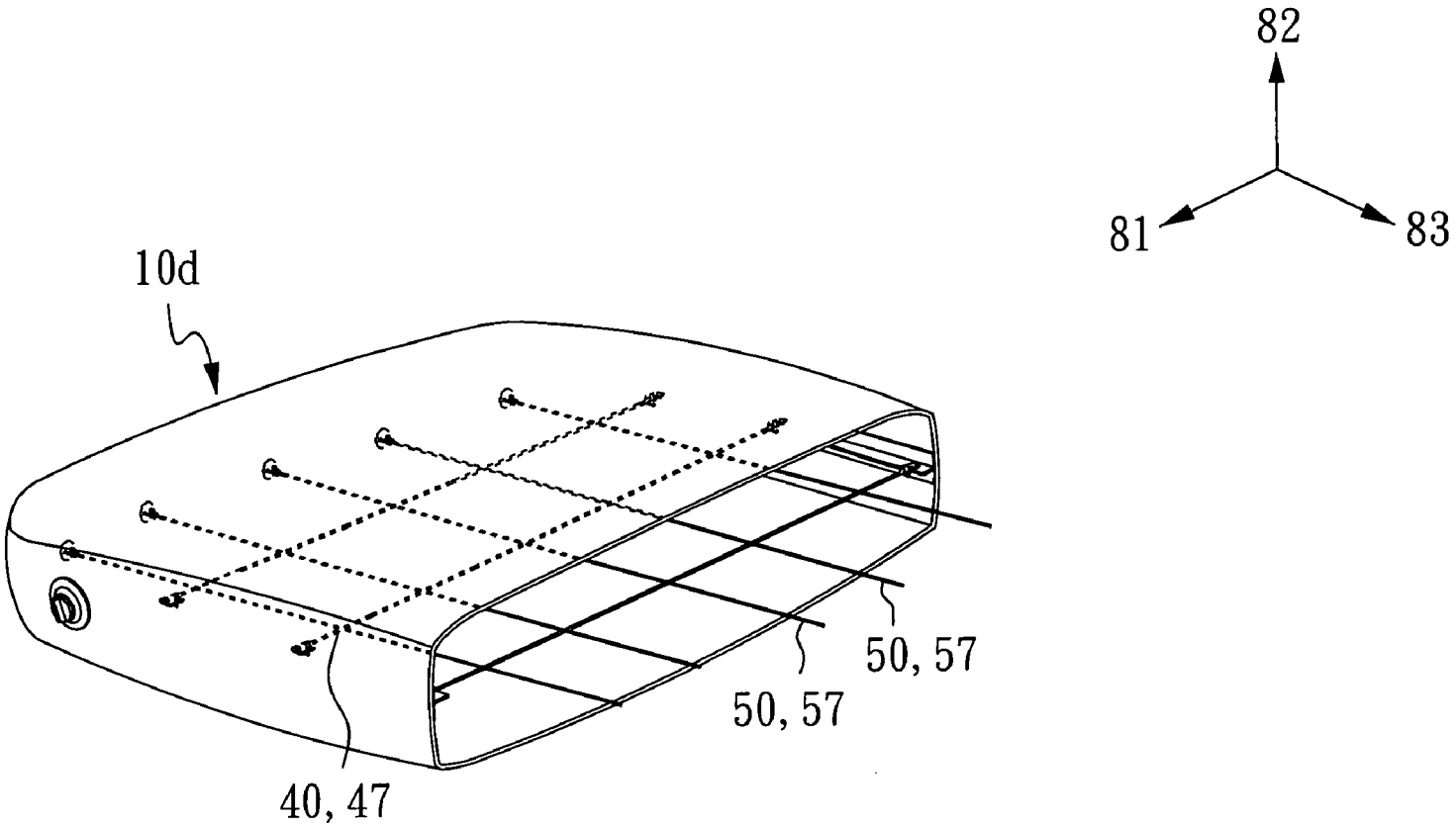
FIG. 7 is a perspective view of a fifth embodiment according to the present invention.

Please refer to FIG. 7 for a fifth embodiment. The major difference between the first and fifth embodiment is that the second tension member 50 in the inflatable air cushion 10*d* is a strap member 57 instead of a sheet member 56.

Figure 8:
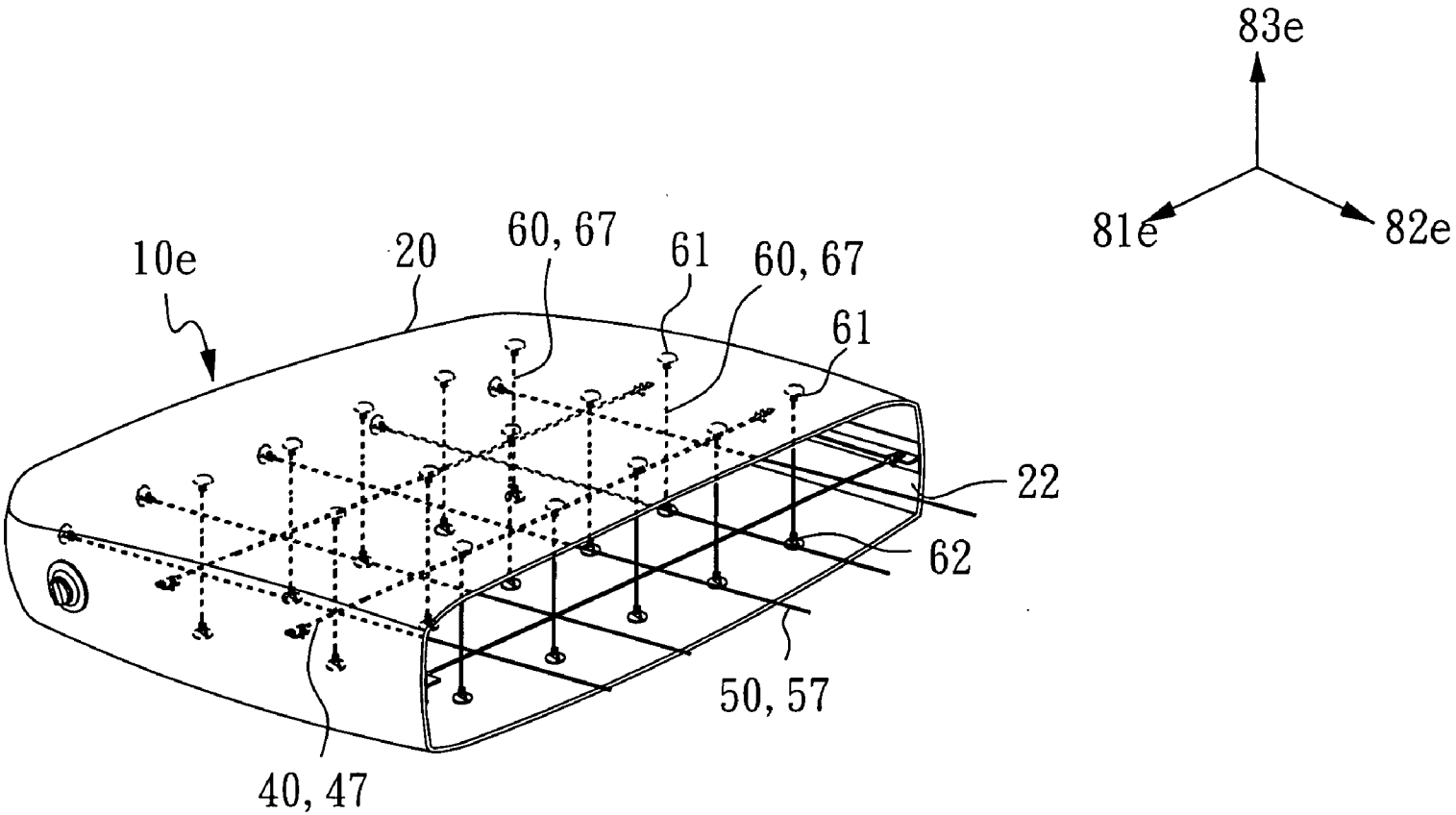
FIG. 8 is a perspective view of a sixth embodiment according to the present invention.

Please refer to FIG. 8 for a sixth embodiment. The major difference between the fifth and sixth embodiments is that the inflatable air cushion 10*e* further comprises a plurality of third tension members 60. Each third tension member 60 is a strap member 67 and has two ends 61, 62 that are connected to the inner surface 22 of the cover 20 so that the strap member 67 can pull along the third direction axis 83 when the inflatable air cushion 10*e* is inflated. The first tension member 40 (strap member 47) along the first direction axis 81*e* comes under tension, and the second tension member 50, (strap member 57) along the second direction axis 82*e* comes under tension.

Figure 9:
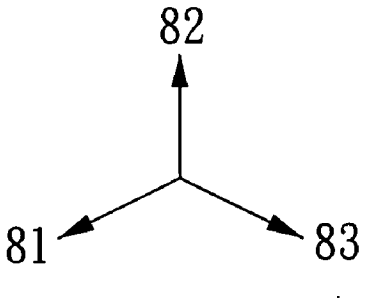
FIG. 9 is a perspective view of a seventh embodiment according to the present invention.
Figure 9:
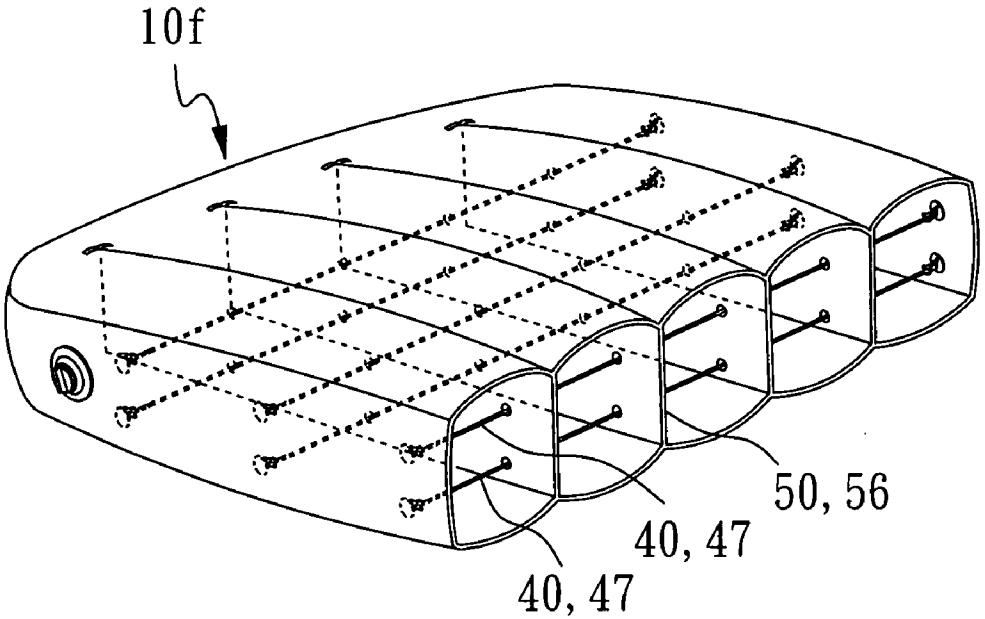

Please refer to FIG. 9 for a seventh embodiment. The major purpose of this embodiment is to show that the inflatable air cushion 10*f* can have more than one set of lines for the first tension member 40 (strap member 47).

Figure 10:
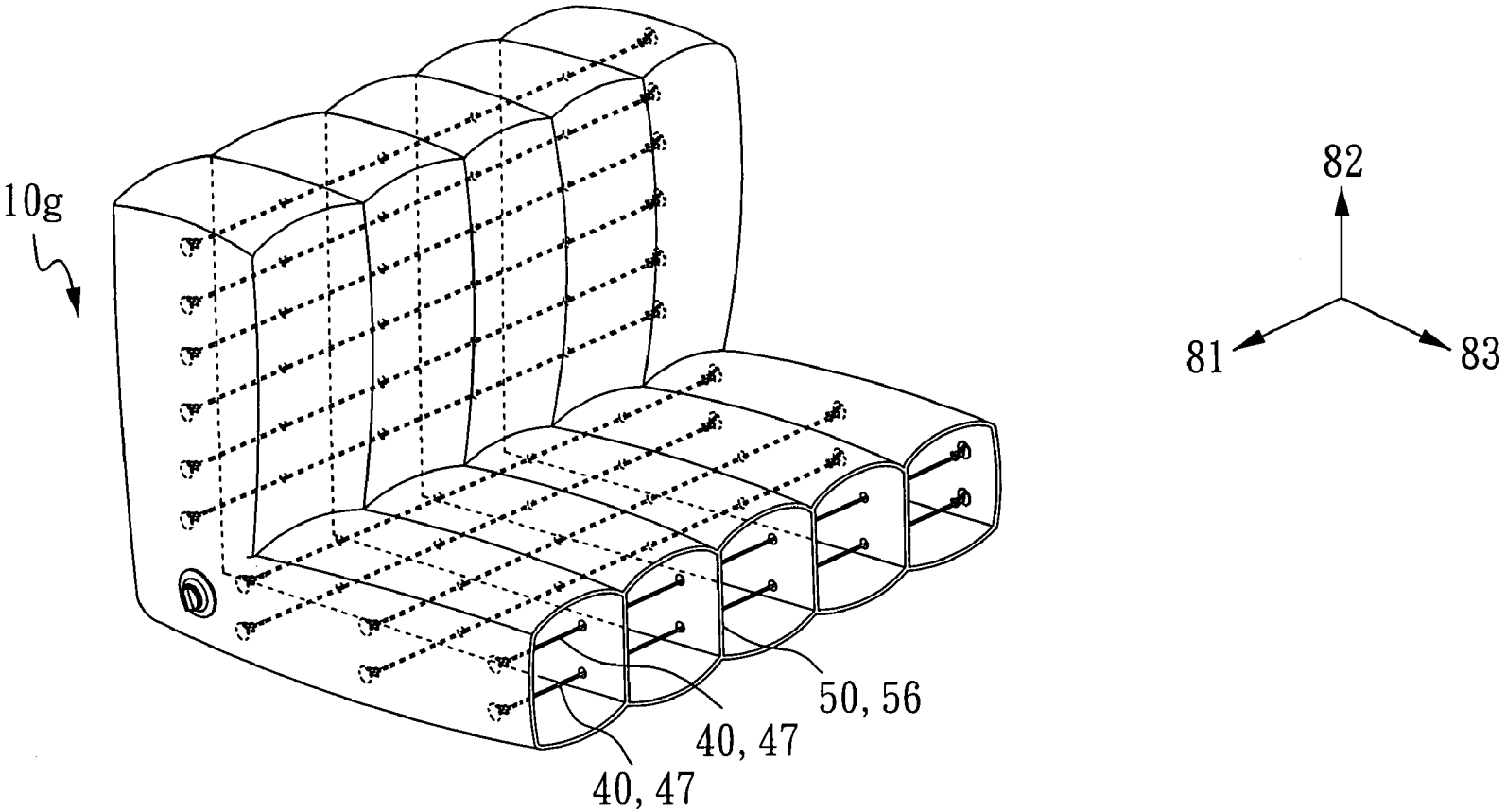
FIG. 10 is a perspective view of an eighth embodiment according to the present invention.

Please refer to FIG. 10 for an eighth embodiment. The major purpose of this embodiment is to show that the inflatable air cushion 10*g* can have any shape, and is not limited to only rectangular shapes; the first tension member 40 (strap member 47) and the second tension member 50, (sheet member 56) can be disposed at different positions or have different shapes according to the shape of the inflatable air cushion 10*g*.

Figure 11:
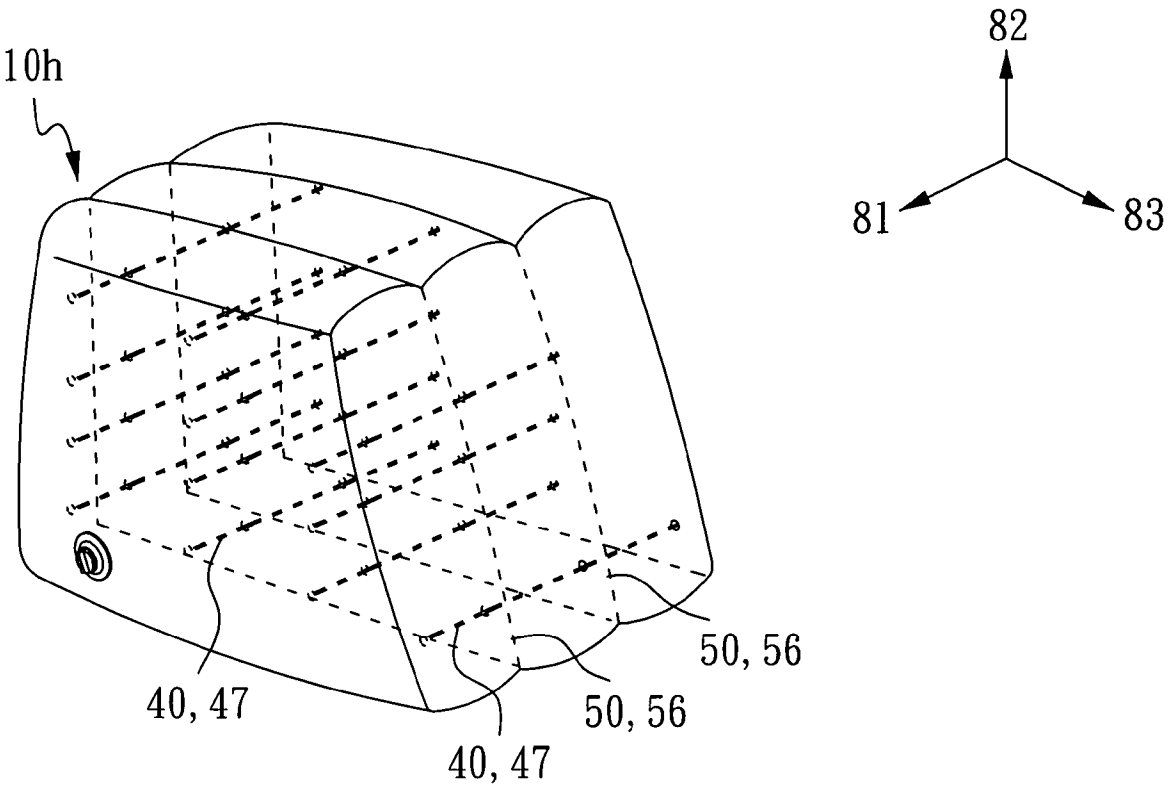
FIG. 11 is a perspective view of a ninth embodiment according to the present invention.

Please refer to FIG. 11 for a ninth embodiment. The major purpose of this embodiment is to further show that the inflatable air cushion 10*h* can have any shape, is not limited to only rectangular shapes, and may have inclined surfaces; the first tension member 40 (strap member 47) and the second tension member 50 (sheet member 56) can be disposed at different positions or have different shapes according to the shape of the inflatable air cushion 10*h*.

Although the present invention has been explained in relation to its preferred embodiment, it is to be understood that many other possible modifications and variations can be made without departing from the spirit and scope of the invention as hereinafter claimed.

What is claimed is:

1. An inflatable air cushion comprising:

a cover comprising an outer surface and an inner surface;

a gas containment chamber capable of forming a three-dimensional space filled with gas, first direction axis, a second direction axis and a third axis defining the three-dimensional space, wherein all axes are perpendicular to each other;

an inflation device installed on the cover;

a plurality of first tension members, wherein each first tension member is a strap member and comprises at least two ends, the two ends of each first tension member are connected to the inner surface of the cover so that the first tension members along the first direction axis come under tension when the inflatable air cushion is inflated; and a plurality of second tension members, wherein each second tension member is a sheet member having a plurality of apertures and each first tension member being disposed through apertures of the second tension members, and each second tension member comprises at least two ends, the two ends of each second tension member connected to the inner surface of the cover so that the second tension members along the second axis come under tension when the inflatable air cushion is inflated.

2. The inflatable air cushion as claimed in claim 1, wherein the sheet member includes four ends which are all connected to the inner surface of the cover so the sheet members along the second direction axis and the third direction axis come under tension when the inflatable air cushion is inflated.

3. The inflatable air cushion as claimed in claim 2 further comprising a plurality of third tension members, wherein each third tension member is a strap member and has two ends, and the two ends of each strap member are connected to the inner surface of the cover so that the strap member along the third direction axis comes under tension when the inflatable air cushion is inflated.

4. The inflatable air cushion as claimed in claim 1, further comprising a plurality of third tension members, wherein each third tension member is a strap member and has two ends, and the two ends of each strap member are connected to the inner surface of the cover so that the strap member along the third direction axis comes under tension when the inflatable air cushion is inflated.

* * * * *